US007178372B1

(12) United States Patent
Shen

(10) Patent No.: US 7,178,372 B1
(45) Date of Patent: Feb. 20, 2007

(54) COMBINATION OF LOCKING BUTTON AND SPINDLE FOR LOCK

(75) Inventor: Mu-Lin Shen, Tainan (TW)

(73) Assignee: I-Tek Metal Mfg. Co., Ltd., Annan (TW)

( * ) Notice: Subject to any disclaimer, the term of this patent is extended or adjusted under 35 U.S.C. 154(b) by 0 days.

(21) Appl. No.: 11/306,885

(22) Filed: Jan. 13, 2006

(51) Int. Cl.
*E05B 13/10* (2006.01)

(52) U.S. Cl. ..... 70/224; 70/216; 70/476; 70/DIG. 73; 292/336.3

(58) Field of Classification Search ..... 70/216, 70/224, 472, 476, 479, DIG. 20, DIG. 73; 292/336.3, 347
See application file for complete search history.

(56) References Cited

U.S. PATENT DOCUMENTS 1,944,470 A * 1/1934 Schlage ..... 70/DIG. 73
2,662,387 A * 12/1953 Hagstrom ..... 70/472
2,743,123 A * 4/1956 Alexander ..... 292/347
3,025,096 A * 3/1962 Williams ..... 292/336.3
3,800,573 A * 4/1974 Babb et al. ..... 70/477
5,232,255 A * 8/1993 Palmer et al. ..... 292/336.3
5,284,372 A * 2/1994 Lin ..... 292/336.3
5,941,108 A * 8/1999 Shen ..... 70/224
6,098,434 A * 8/2000 Liou ..... 70/DIG. 20
6,575,006 B1 * 6/2003 Don ..... 70/472
2003/0222464 A1 * 12/2003 Don ..... 292/347

* cited by examiner

*Primary Examiner*—Suzanne Dino Barrett
*Assistant Examiner*—Christopher Boswell
(74) *Attorney, Agent, or Firm*—Alan D. Kamrath; Nikolai & Mersereau, P.A.

(57) ABSTRACT

A combination of a locking button and a spindle for a lock includes a spindle having a longitudinal hole and a locking button having a grip portion for manual turning and a shank that is mounted in the longitudinal hole of the spindle. A guiding groove is defined in a circumference delimiting the longitudinal hole and extending along a circumferential direction. The shank includes a coupling section including a protrusion engaged in the guiding groove and movable between two end walls delimiting the guiding groove, allowing the locking button to be movable between a locking position and an unlocking position.

4 Claims, 10 Drawing Sheets

COMBINATION OF LOCKING BUTTON AND SPINDLE FOR LOCK

BACKGROUND OF THE INVENTION

1. Field of the Invention

The present invention relates to a combination of a locking button and a spindle for a lock. More particularly, the present invention relates to a combination of a locking button and a spindle for a tubular lock.

2. Description of the Related Art

FIGS. 1 and 2 of the drawings illustrate a conventional tubular lock comprising an inner assembly 1, an outer assembly 2, and a latch mechanism 3. The inner assembly 1 comprises an inside handle 11, an inside spindle 12 securely coupled to the inside handle 11 to turn therewith, and a locking button 13 extending through a through-hole 111 of the inside handle 11. The outer assembly 2 comprises an outside handle 21, an outside spindle 22 securely coupled to the outside handle 21 to turn therewith, and a locking/unlocking bar 23. The outside spindle 22 is extended through a square hole 321 of a wheel 32 of the latch mechanism 3 and coupled with the inside spindle 12 such that rotation of either handle 11, 21 turns the wheel 32 and, thus, retracts the latch 31.

The locking button 13 comprises a shank 131 mounted in a longitudinal hole 122 of the inside spindle 12 and a grip portion 132 for manual gripping for turning the locking button 13. The locking button 13 includes an annular groove 133 into which a plurality of lugs 121 on the inside spindle 12 extends, preventing the locking button 13 from disengaging from the inside spindle 12 while allowing the locking button 13 to turn relative to the inside spindle 12. An end of the locking/unlocking bar 23 is extended into a receptacle 134 in an inner end face 135 of the shank 131 of the locking button 13. When the locking button 13 is turned through 90 degrees to a locking position, the locking/unlocking bar 23 is also turned to a locking position not allowing retraction of the latch 31. When a key is used for unlocking purposes, the locking/unlocking bar 23 and the locking button 13 are returned to their original position.

However, assembly of the locking button 13 and the inside spindle 12 is troublesome. More specifically, in assembly, the locking button 13 is inserted into the longitudinal hole 122 of the inside spindle 12 until the annular groove 133 of the locking button 13 is aligned with the lugs 121 of the inside spindle 12. Then, the lugs 121 are pressed inward into the annular groove 133 of the locking button 13 to prevent the locking button 13 from disengaging from the inside spindle 12 while allowing the locking button 13 to turn relative to the inside spindle 12. The assembling procedure is, thus, time-consuming and troublesome.

BRIEF SUMMARY OF THE INVENTION

An objective of the present invention is to provide a combination of a locking button and an inside spindle for a lock that allows easy assembly.

A combination of a locking button and a spindle for a lock in accordance with the present invention comprises a spindle comprising a longitudinal hole and a locking button comprising a grip portion for manual turning and a shank that is mounted in the longitudinal hole of the spindle. A guiding groove is defined in a circumference delimiting the longitudinal hole and extending along a circumferential direction. The shank comprises a coupling section including a protrusion engaged in the guiding groove and movable between two end walls delimiting the guiding groove, allowing the locking button to be movable between a locking position and an unlocking position.

Preferably, the coupling section is flexible in a radial direction of the locking button.

Preferably, the shank of the locking button comprises a substantially U-shaped slot to form the coupling section.

Preferably, the shank of the locking button comprises a receptacle in an end face thereof, and the slot is in communication with the receptacle.

Preferably, the protrusion comprises a front, inclined face and a rear, vertical stop face. The inclined face allows the protrusion to be easily inserted into the guiding groove of the spindle whereas the vertical stop face prevents the protrusion from disengaging from the guiding groove of the spindle.

Preferably, the locking button further comprises a flange that abuts against an end face of the inside spindle.

Other objectives, advantages, and novel features of the invention will become more apparent from the following detailed description when taken in conjunction with the accompanying drawings.

DETAILED DESCRIPTION OF THE INVENTION

Figure 1:
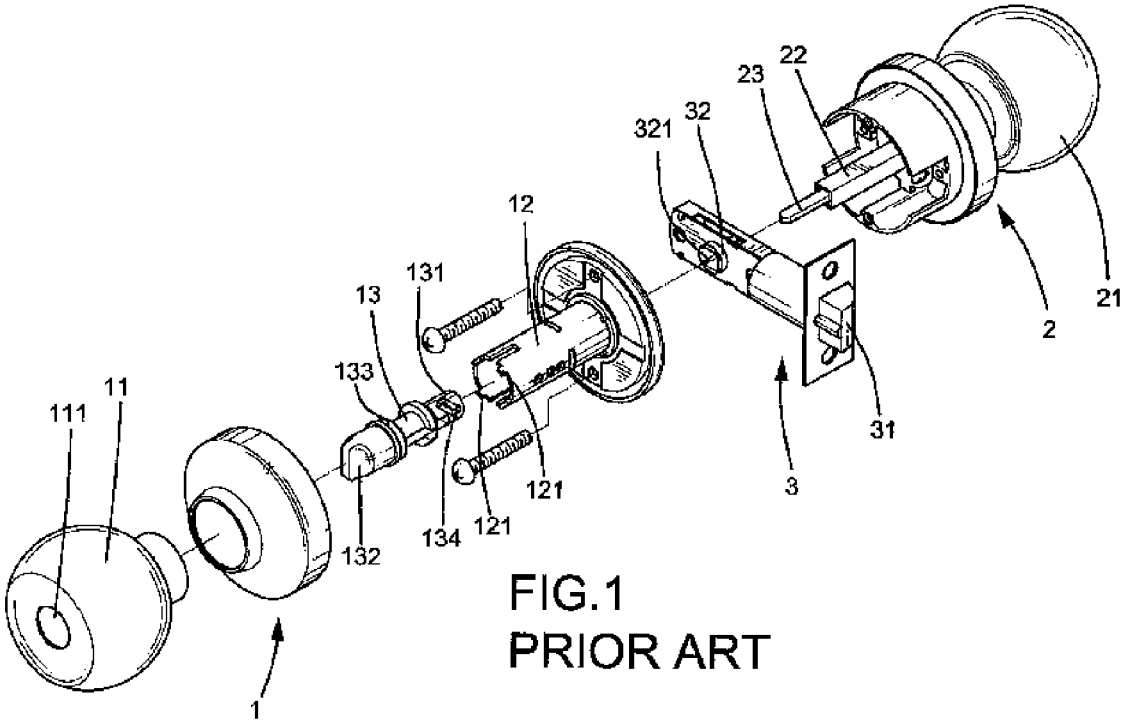
FIG.1 PRIOR ART
FIG. 1 is an exploded perspective view of a conventional tubular lock.
Figure 2:
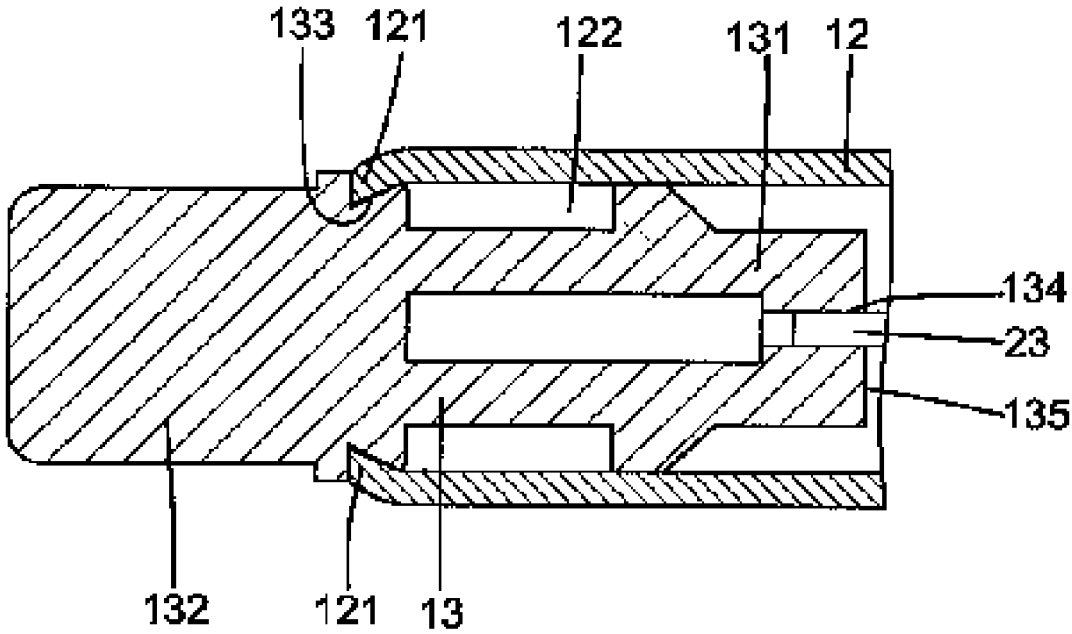
FIG.2 PRIOR ART
FIG. 2 is a sectional view of an inside spindle and a locking button of the conventional tubular lock in FIG. 1.
Figure 3:
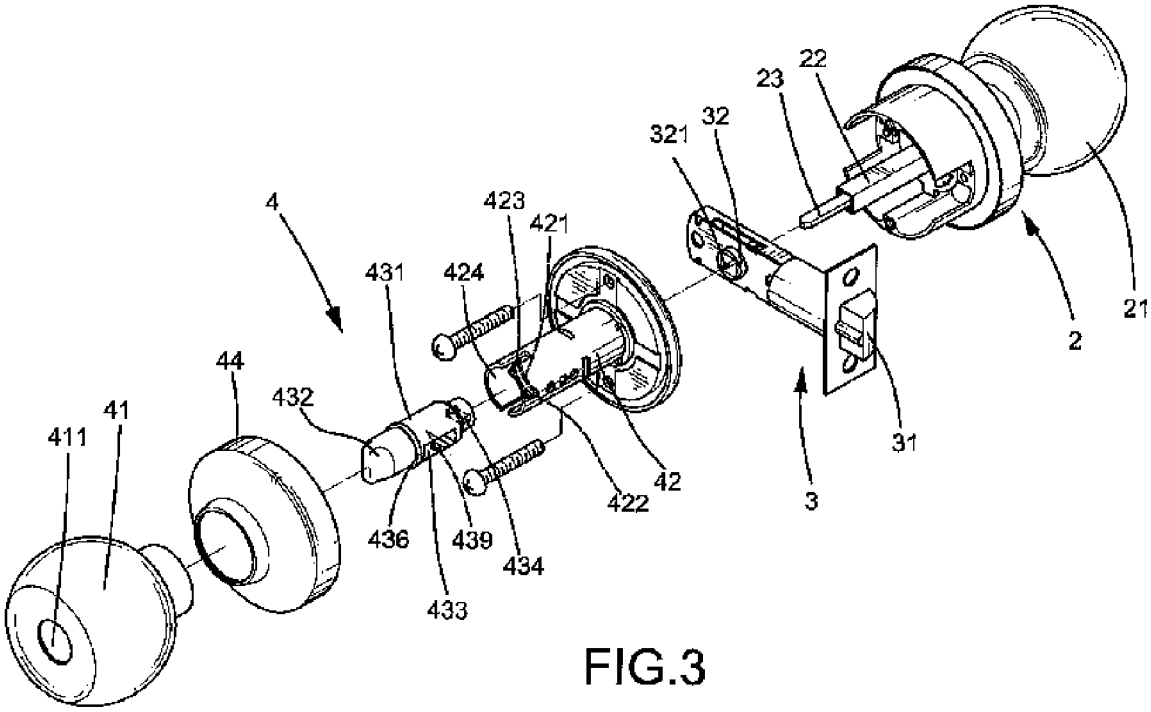
FIG. 3 is an exploded perspective view of a tubular lock with a combination of a locking button and a spindle in accordance with the present invention.

FIG. 3 shows a tubular lock with a combination of a locking button and a spindle in accordance with the present invention. In this embodiment, the spindle is an inside spindle of the tubular lock.

Figure 4:
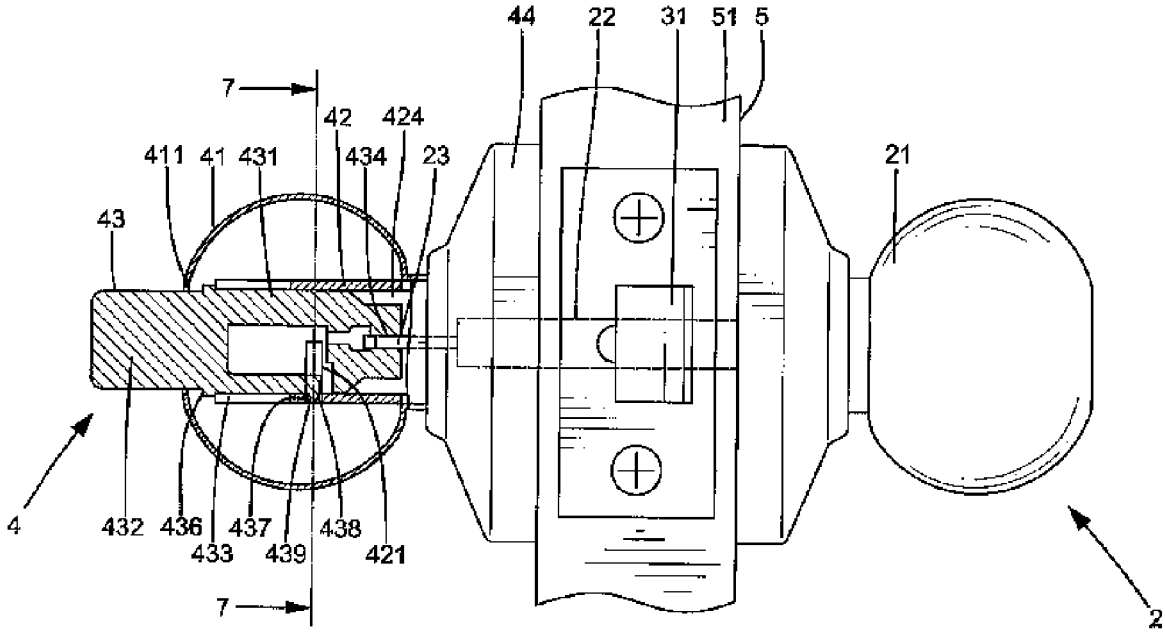
FIG. 4 is a side view, partly sectioned, of the tubular lock in FIG. 3 and a portion of a door to which the tubular lock is mounted.

Still referring to FIG. 3 and further to FIG. 4, the tubular lock comprises an inner assembly 4, an outer assembly 2, and a latch mechanism 3. The elements of the tubular lock in accordance with the present invention similar to those of the conventional one are labeled with same reference numbers without any limiting intention.

The latch mechanism 3 is mounted in a compartment (not labeled) in an edge 51 of a door 5 to which the tubular lock is mounted. The latch mechanism 3 comprises a housing (not labeled) in which a wheel 32 is rotatably mounted and a latch 31. The wheel 32 includes a square hole 321.

The inner assembly 4 comprises an inside handle 41, an inside spindle 42 securely coupled to the inside handle 41 to turn therewith, an inside rose 44, and a locking button 43 extending through a through-hole 411 of the inside handle 41. The inside spindle 42 comprises a longitudinal hole 424, with a guiding groove 421 defined in an inner circumference delimiting the longitudinal hole 424 and extending in a circumferential direction and with the guiding groove 421 delimited between two end walls 422 and 423. Preferably, the guiding groove 421 extends through a length of about 90 degrees along the circumferential direction.

The outer assembly 2 comprises an outside handle 21, an outside spindle 22 securely coupled to the outside handle 21 to turn therewith, and a locking/unlocking bar 23. The outside spindle 22 is extended through the square hole 321 of the wheel 32 of the latch mechanism 3 and coupled with the inside spindle 42 such that rotation of either handle 41, 21 turns the wheel 32 and, thus, retracts the latch 31.

The locking button 43 comprises a shank 431 mounted in the longitudinal hole 424 of the inside spindle 42. Preferably, an outer diameter of the shank 431 is slightly smaller than a diameter of the longitudinal hole 424 of the inside spindle 42. The locking button 43 further comprises a grip portion 432 allowing a user to grip the grip portion 432 for turning the locking button 43. The shank 431 of the locking button 43 includes a receptacle 434 in an inner end face thereof, and an end of the locking/unlocking bar 23 is extended into the receptacle 434.

Figure 5:
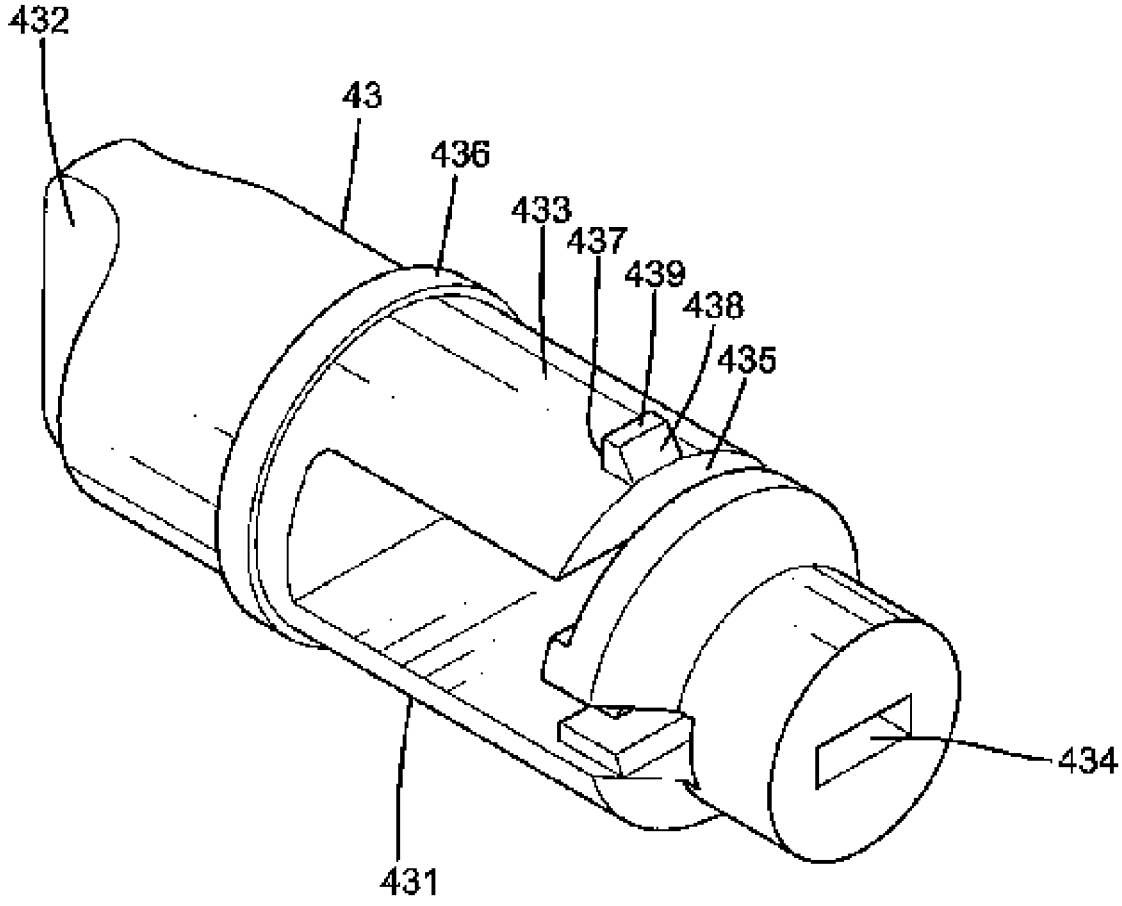
FIG. 5 is a perspective view of the locking button in accordance with the present invention.

The locking button 43 further comprises a flange 436 on a rear portion of the shank 431. The flange 436 abuts against an end face of the inside spindle 42 when the shank 431 of the locking button 43 is mounted into the inside spindle 42. Further, the locking button 43 comprises a coupling section 433. Preferably, the coupling section 433 is on the shank 431 and adjacent to the flange 436. Referring to FIG. 5, the coupling section 433 includes a protrusion 439 that is engaged in the guiding groove 421 of the inside spindle 42.

In the illustrated embodiment shown in FIG. 5, the coupling section 433 is flexible in a radial direction, allowing the protrusion 439 to enter the guiding groove 421 of the inside spindle 42. The shank 431 is cut to form a substantially U-shaped slot 435, providing a tongue-like coupling section 433. The slot 435 provides the required flexibility for the coupling section 433. The slot 435 may be in communication with the receptacle 434 of the locking button 43.

Figure 6:
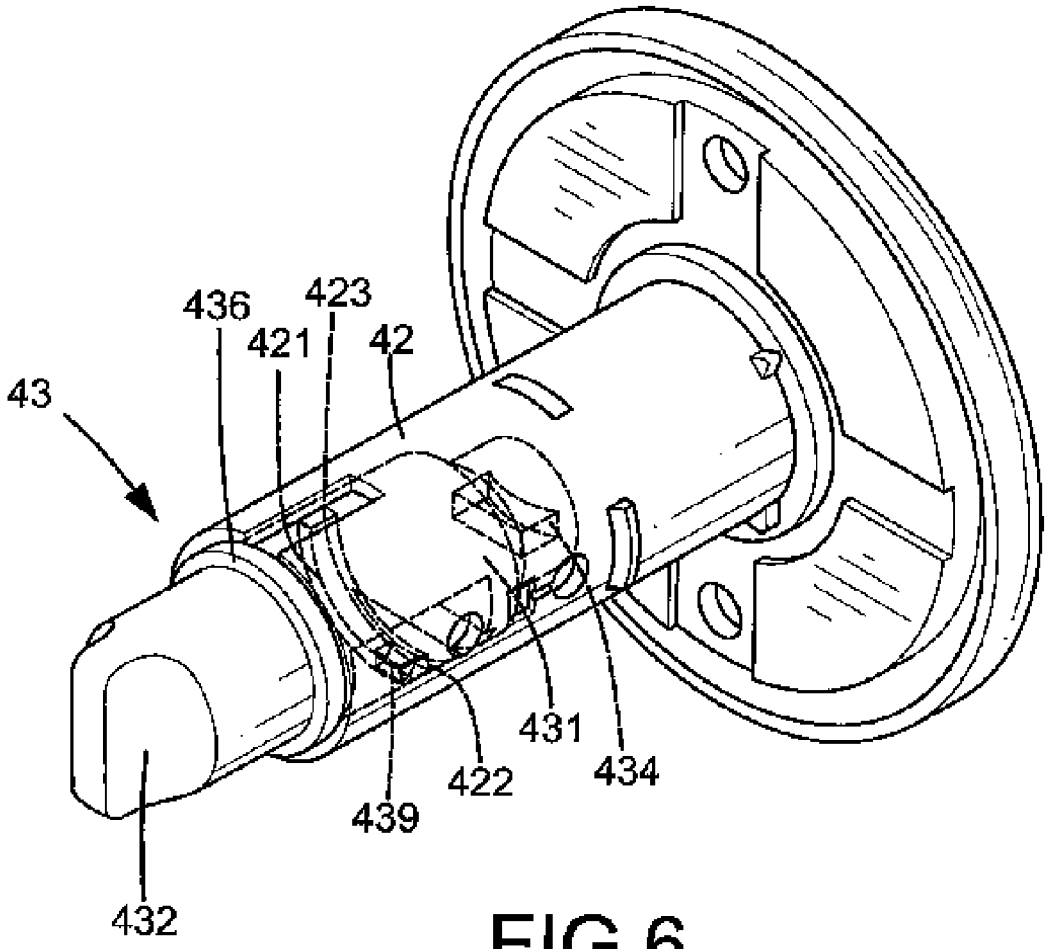
FIG. 6 is a perspective view illustrating the locking button and the spindle in accordance with the present invention.
Figure 8:
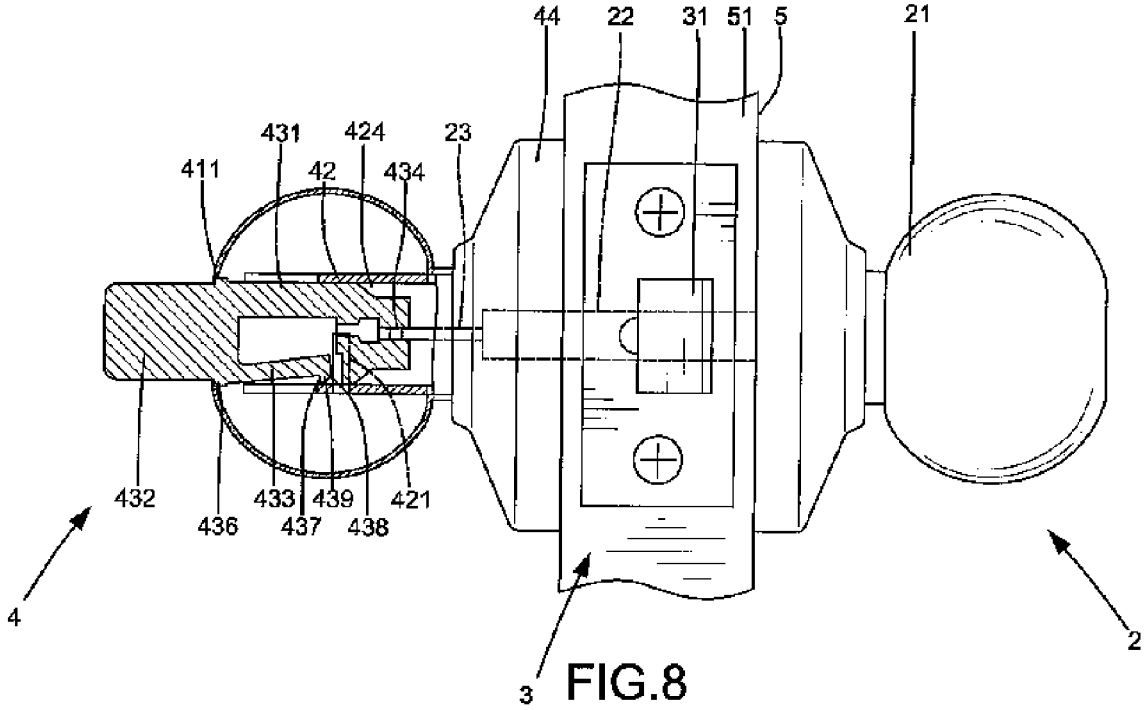
FIG. 8 is a view similar to FIG. 4, illustrating mounting of a shank of the locking button into the inside spindle.

Referring to FIG. 5, the protrusion 439 is preferably on a front end of the coupling section 433. Preferably, the protrusion 439 comprises a front, inclined face 438 and a rear, vertical stop face 437. Referring to FIG. 8, when inserting the shank 431 of the locking button 43 into the inside spindle 42, the coupling section 433 flexes radially inward when the inclined face 438 of the protrusion 439 slides across the end edge of the inside spindle 42. Referring to FIGS. 4 and 6, when the protrusion 439 of the locking button 43 enters the guiding groove 421 of the inside spindle 42, the coupling section 433 returns to its original position. Disengagement of the protrusion 439 from the guiding groove 421 is prevented, as the vertical stop face 437 of the protrusion 439 will be stopped by a circumferential wall delimiting the guiding groove 421 when the locking button 43 is pulled outward. Hence, disengagement of the locking button 43 from the inside spindle 42 is prevented. Further, the locking button 43 is rotatable through 90 degrees relative to the inside spindle 42, as the protrusion 439 is slidably received in the guiding groove 421 of the inside spindle 42 and between the end walls 422 and 423 delimiting the guiding groove 421.

Figure 7:
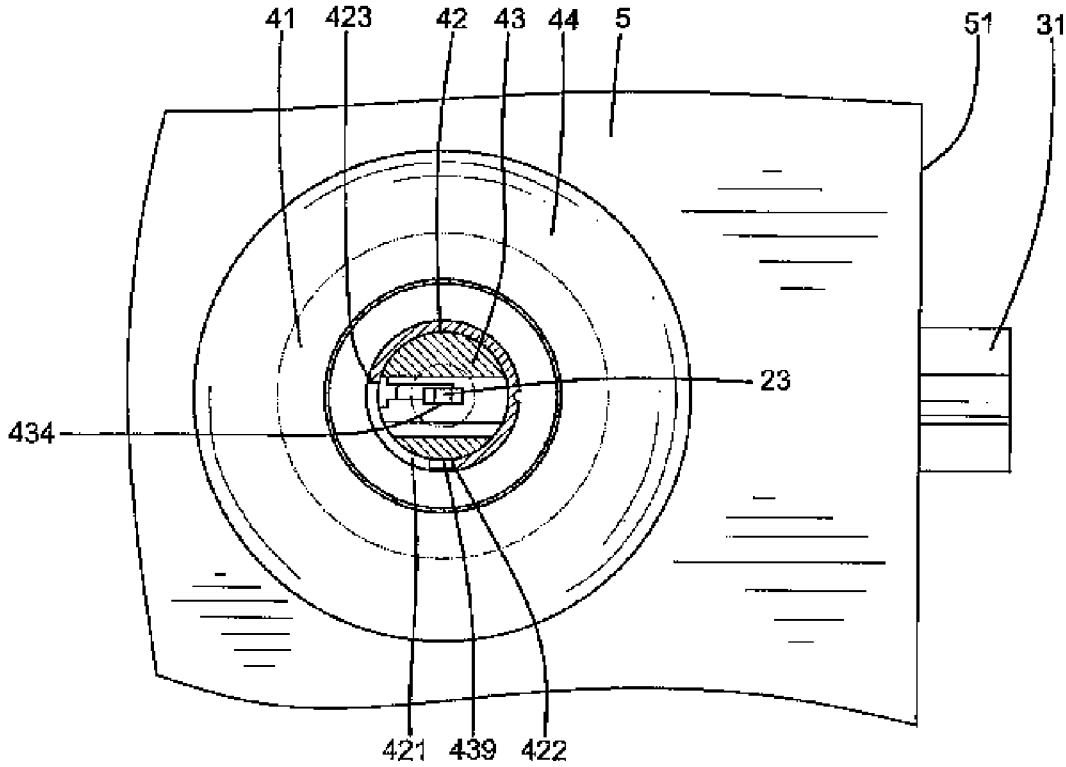
FIG. 7 is a sectional view taken along plane 7—7 in FIG. 4.
Figure 9:
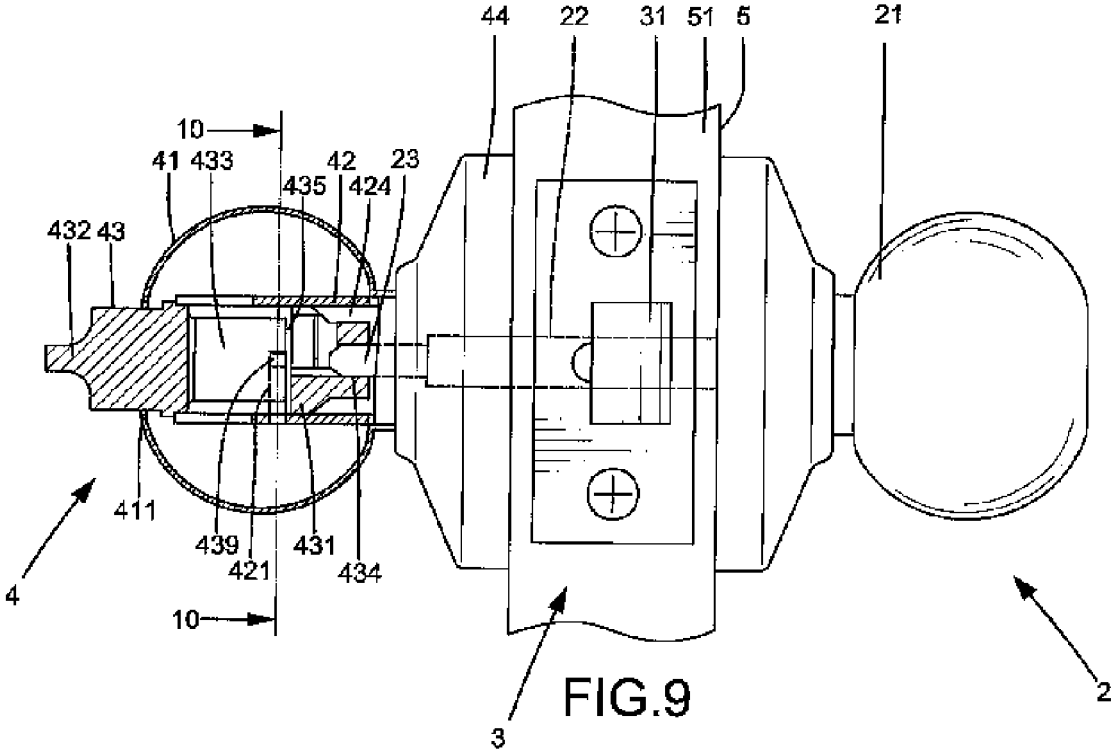
FIG. 9 is a view similar to FIG. 4, wherein the locking button is turned through 90 degrees to a locking position.
Figure 10:
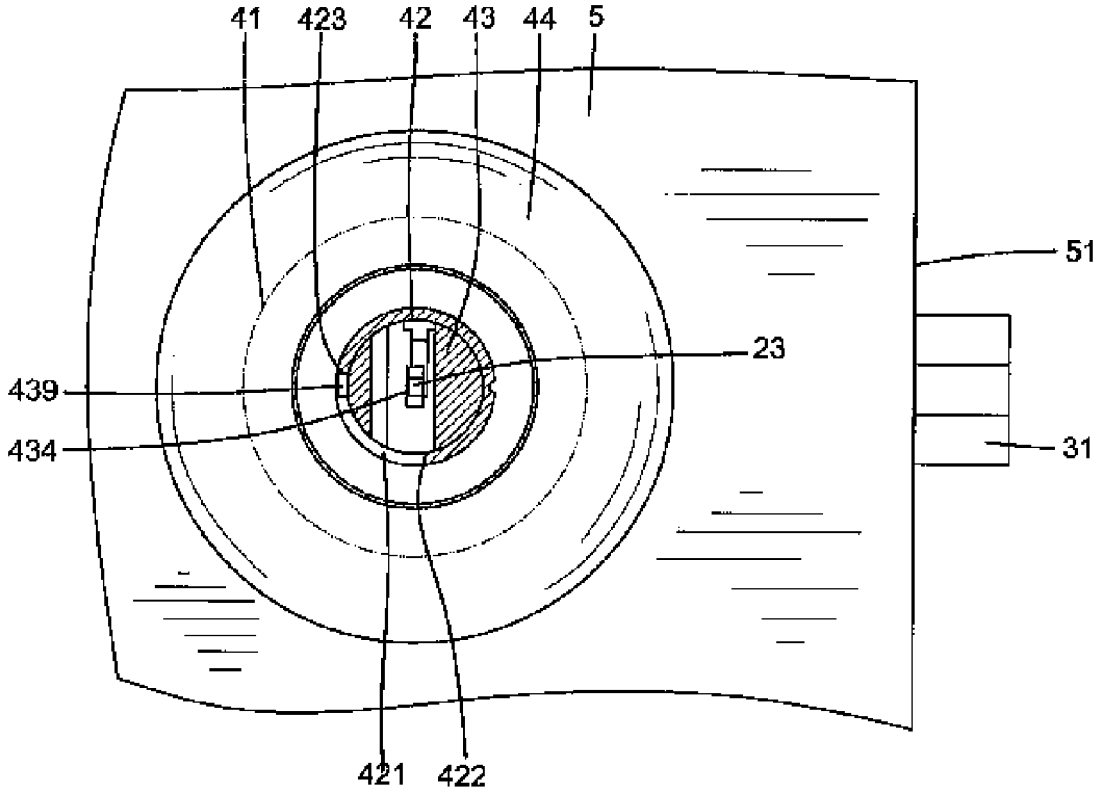
FIG. 10 is a sectional view taken along plane 10—10 in FIG. 9.

The locking button 43 in FIGS. 4 and 7 is in an unlocking position, wherein the protrusion 439 of the locking button 43 is in an end of the guiding groove 421 of the inside spindle 42. The locking button 43 can be turned through 90 degrees to a locking position shown in FIGS. 9 and 10, wherein the protrusion 439 of the locking button 43 is in the other end of the guiding groove 421 of the inside spindle 42. The locking/unlocking bar 23 turns together with the locking button 43 to a locking position, which is conventional. Unlocking can be achieved by turning the locking button 43 in a reverse direction or by a key from outside of the door 5.

It is noted that use of the combination of a locking button and an inside spindle in accordance with the present invention is not limited to tubular locks. Further, the combination of the present invention is not limited to the inside spindle. Namely, the locking button can be coupled with an outside spindle when desired.

Although a specific embodiment has been illustrated and described, numerous modifications and variations are still possible without departing from the essence of the invention. The scope of the invention is limited by the accompanying claims.

What is claimed is:

1. A combination comprising:

a spindle comprising a longitudinal hole, a guiding groove being defined in a circumference delimiting the longitudinal hole and extending along a circumferential direction; and a locking button comprising a grip portion for manual turning and a shank that is mounted in the longitudinal hole of the spindle, the shank comprising a substantially U-shaped slot in an outer circumference thereof to form a tongue-like coupling section that is surrounded by the U-shaped slot and that is flexible in a radial direction of the locking button, the coupling section including a protrusion engaged in the guiding groove and being movable between two end walls delimiting the guiding groove, allowing the locking button to be movable between a locking position and an unlocking position.

2. The combination as claimed in claim 1, with the shank of the locking button comprising a receptacle in an end face thereof, and with the substantially U-shaped slot being in communication with the receptacle.

3. The combination as claimed in claim 1, with the protrusion comprising a front, inclined face and a rear, vertical stop face.

4. The combination as claimed in claim 1, with the locking button further comprising an annular flange spaced from the substantially U-shaped slot and the protrusion, wherein the annular flange abuts against an end face of the spindle.

* * * * *